US005794785A

United States Patent [19]

Simon

[11] Patent Number: 5,794,785

[45] Date of Patent: Aug. 18, 1998

[54] CONTAINER FOR A VANITY TOP OR THE LIKE

[75] Inventor: Ron M. Simon, Anaheim, Calif.

[73] Assignee: RSI Home Products, Inc., Anaheim, Calif.

[21] Appl. No.: 670,566

[22] Filed: Jun. 26, 1996

Related U.S. Application Data

[60] Provisional application No. 60/000,617 Jun. 30, 1995.

[51] Int. Cl.[6] ..... B65D 5/50

[52] U.S. Cl. ..... 206/783; 206/757; 206/760; 206/762; 206/773; 206/784; 206/321; 229/164

[58] Field of Search ..... 206/756, 757, 206/759, 760, 762, 766, 772, 773, 321, 783, 784; 229/143, 169, 164

[56] References Cited

U.S. PATENT DOCUMENTS

| | | | |
|---|---|---|---|
| D. 207,746 | 5/1967 | Cote . | |
| D. 278,126 | 3/1985 | Benham . | |
| D. 291,065 | 7/1987 | Pugh . | |
| D. 332,744 | 1/1993 | McCooey . | |
| D. 348,000 | 6/1994 | Strasevicz et al. . | |
| 2,278,359 | 3/1942 | Nagle . | |
| 2,300,411 | 11/1942 | Dubey . | |
| 2,307,720 | 1/1943 | Ringler . | |
| 2,509,447 | 5/1950 | Prawdzik . | |
| 2,649,807 | 8/1953 | Ritter . | |
| 2,654,470 | 10/1953 | Borucki | 206/783 |
| 2,678,724 | 5/1954 | Andriot, Jr. . | |
| 2,779,463 | 1/1957 | Zimmerman . | |
| 2,854,135 | 9/1958 | Pantalone | 206/783 X |
| 2,946,433 | 7/1960 | Hennessey | 206/783 |
| 2,998,909 | 9/1961 | Anderson, Jr. et al. . | |
| 3,034,697 | 5/1962 | Frankenstein . | |
| 3,038,513 | 6/1962 | Hamlett . | |
| 3,043,492 | 7/1962 | Stewart, Jr. . | |
| 3,099,351 | 7/1963 | Coffey, Jr. . | |
| 3,133,633 | 5/1964 | Redmond . | |
| 3,144,131 | 8/1964 | Pitt et al. . | |
| 3,181,694 | 5/1965 | Candell . | |
| 3,289,825 | 12/1966 | Smith . | |
| 3,363,749 | 1/1968 | Tinapple . | |
| 3,419,133 | 12/1968 | Stone | 206/783 X |
| 3,517,801 | 6/1970 | Cote | 206/756 X |
| 3,750,870 | 8/1973 | Cote | 206/783 X |
| 3,880,287 | 4/1975 | Loeffelman . | |

(List continued on next page.)

FOREIGN PATENT DOCUMENTS 0394549 10/1990 European Pat. Off. .

*Primary Examiner*—Bryon P. Gehman
*Attorney, Agent, or Firm*—Pillsbury Madison & Sutro LLP

[57] ABSTRACT

A packaging container that includes a top and a bottom is formed for holding and displaying an item, such as a vanity or the like. The packaging container is generally formed from blank having a plurality of panels and flaps. A back panel has a first lower flap and a first upper panel. A pair of side panels each has a second lower flap, a first upper flap and an elongated central flap. An upper front extension panel has a second upper panel, and the lower front extension panel has a third lower flap. A tab connected to the back panel is adapted to engage one of the pair of side panels, while the other of the pair of side panels is connected to the back panel opposite the tab. The upper front extension panel and the lower front extension panel are connected between the pair of side panels to form a substantially rectangular tube. The first lower flap, the pair of second lower flaps and the third lower flap are folded to close off the bottom of the packaging container, and the first upper panel, the pair of upper flaps, and the second upper panel are folded to close off the top of the packaging container. The pair of elongated central flaps are folded relative to the pair of side panels and are coupled to the back panel to provide a slanted support surface for the item. An opening is formed between the pair of side panels, the upper front extension panel and the lower front extension panel between the pair of side panels to permit the item to be displayed within the packaging container.

16 Claims, 8 Drawing Sheets

U.S. PATENT DOCUMENTS 3,931,888 1/1976 Fogel .
3,987,893 10/1976 Hanson .
3,989,139 11/1976 Vargo .
4,082,215 4/1978 Eichenauer .
4,133,428 1/1979 Glöyer .
4,155,445 5/1979 Roccaforte .
4,349,147 9/1982 Jensen .
4,385,687 5/1983 Dutcher .
4,418,863 12/1983 Kimbrell, Sr. .
4,574,998 3/1986 Vavra .
4,667,825 5/1987 Durand .
4,671,413 6/1987 Peterson .
4,715,493 12/1987 Dreyfus .
4,759,446 7/1988 Dobashi et al. .
4,807,746 2/1989 Jacobs .
4,811,840 3/1989 Muyskens .
4,860,948 8/1989 Hofstede .
4,871,068 10/1989 Dreyfus .
4,883,221 11/1989 Brundage .
4,925,088 5/1990 Ostrander .
5,161,699 11/1992 Hanna et al. .
5,322,212 6/1994 Strasevicz et al. .
5,429,232 7/1995 Orr et al. .
5,522,502 6/1996 Orr et al. .
5,579,991 12/1996 Strasevicz et al. ..... 229/164

CONTAINER FOR A VANITY TOP OR THE LIKE

RELATED APPLICATIONS

This application claims the benefit of the filing date of provisional application Ser. No. 60/000,617 filed Jun. 30, 1995.

FIELD OF THE INVENTION

This invention relates to a container for holding and displaying a large, heavy article and, in particular embodiments, to a container for holding and displaying a bathroom vanity top.

BACKGROUND OF THE INVENTION

Traditionally, containers for large, heavy articles, such as bathroom vanity tops, have been rectangular containers that entirely enclose the large, heavy article. In addition, the rectangular containers have been augmented with inserts, such as Styrofoam or cardboard, to maintain the heavy article-in the proper orientation. Drawbacks to the typical container are the necessity for these multiple pieces (container and inserts) and the inability to see the enclosed large, heavy article without opening the box.

To overcome these drawbacks, containers formed from one piece that are simply folded and also permit viewing of the enclosed large, heavy article have been developed. These containers held large, heavy articles so that they could be viewed while inside the container without opening the container. These containers also obviated the need to use separate inserts. However, these one-piece containers were typically assembled only by folding and were often incapable of properly securing the large, heavy articles during transport. For example, the weight of the large, heavy article would often cause these containers to tear or unfold during transport, allowing the large, heavy article to fall out of the one-piece container.

SUMMARY OF THE DISCLOSURE

It is an object of an embodiment of the present invention to provide an improved container for a vanity or the like which obviates for practical purposes the above-mentioned limitations.

According to an embodiment of the invention, a packaging container that includes a top and a bottom is formed for holding and displaying an item, such as a vanity or the like. The packaging container is generally formed from a blank having a plurality of panels and flaps. A back panel has a first lower flap and a first upper panel. Each of a pair of side panels has a second lower flap, a first upper flap and an elongated central flap. An upper front extension panel has a second upper panel, and a lower front extension panel has a third lower flap. A tab connected to the back panel is adapted to engage one of the pair of side panels, while the other of the pair of side panels is connected to the back panel opposite the tab. The upper front extension panel and the lower front extension panel are connected between the pair of side panels to form a substantially rectangular tube. The first lower flap, the pair of second lower flaps and the third lower flap are folded to close off the bottom of the packaging container, and the first upper panel, the pair of upper flaps, and the second upper panel are folded to close off the top of the packaging container. Both of the pair of elongated central flaps are folded relative to the pair of side panels and are coupled to the back panel to provide a slanted support surface for the item. An opening is formed between the pair of side panels, the upper front extension panel and the lower front extension panel between the pair of side panels to permit the item to be displayed within the packaging container.

In preferred embodiments of the present invention, the packaging container is formed from corrugated cardboard. Also, the tab connected to the back panel is coupled to one of the pair of side panels by an adhesive. In particular embodiments, each of the pair of side panels includes a handle that is folded to assist in lifting and moving the packaging container from place to place.

In further embodiments of the present invention, each of the elongated central flaps includes a connecting tab, and the back panel includes a plurality of slots for receiving the connecting tab. The elongated central flaps are secured to the back panel by the connecting tabs being passed through some of the plurality of slots. Also, the first lower flap, the second lower flap and the third lower flap each has a tab-like structure formed on an end of the flap that is adapted to interlock with the corresponding one of the lower flaps to close off the bottom of the packaging container. In addition, the first upper panel and second upper panel each has a tab-like structure formed on an end of its upper panel that is adapted to interlock with the corresponding one of the upper panels to close off the top of the packaging container.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
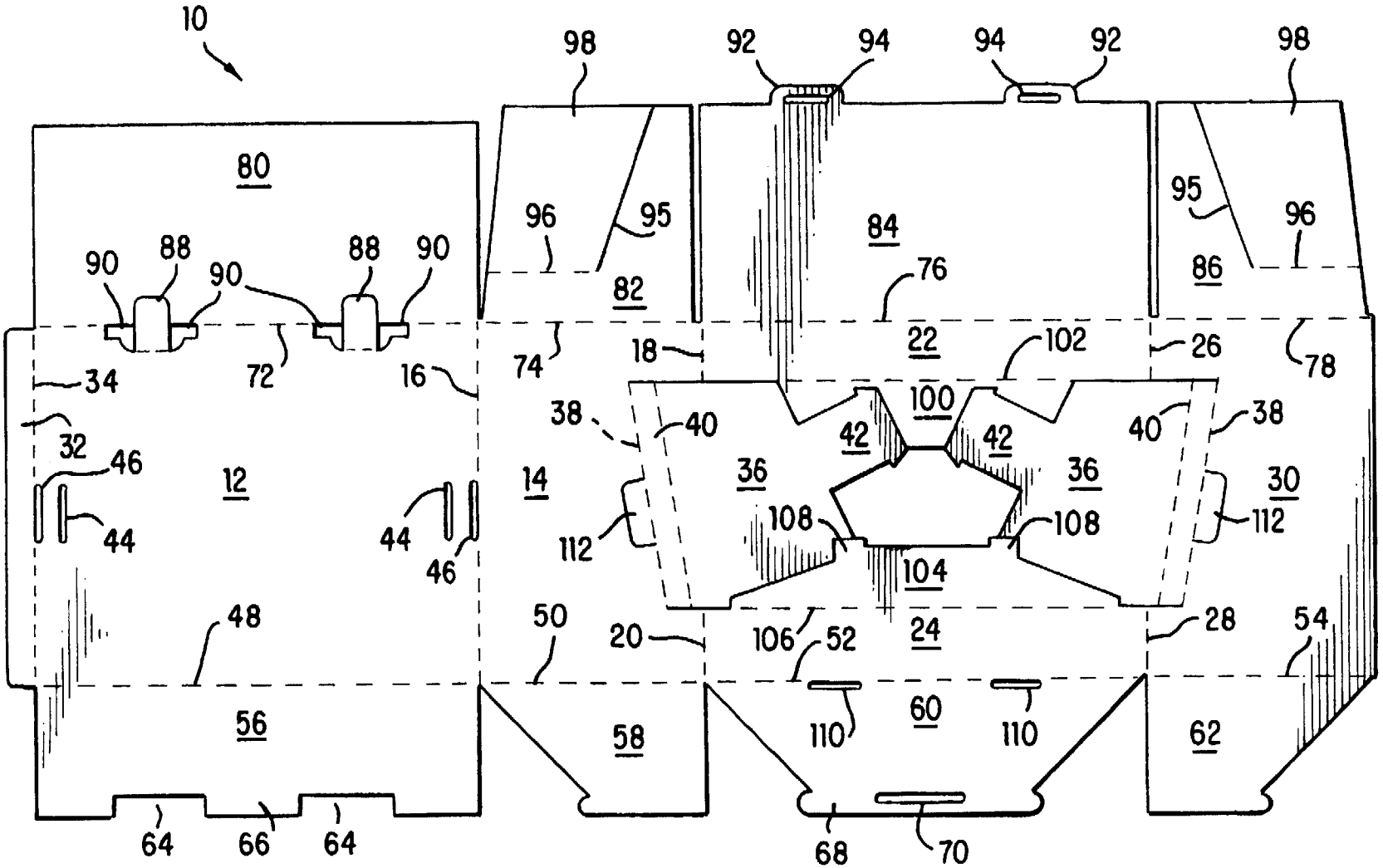
FIG. 1 is a plan view of the packaging container in accordance with a first embodiment of the present invention.

As shown in the drawings for purposes of illustration, the invention is embodied in a shipping container that also serves as a display for an item held within the container. In preferred embodiments of the present invention, the packaging container is used to hold bathroom vanity tops. However, it will be recognized that further embodiments of the invention may be used to hold other items, such as sinks, countertops, mirrors, cabinets or the like.

In preferred embodiments of the present invention, the packaging container 10 is a corrugated paperboard container made from a single piece of sheet material. The material is scored, creased and glued to prepare the packaging container 10 for assembly. However, in alternative embodiments, other materials, such as cardboard, pressboard, plastic, wood, metal or the like, may be used. Also, other connectors, such as hook-and-loop tape, rivets, screws, or the like, may be used to assemble the packaging container.

FIG. 1 is a line drawing that illustrates a stamped blank that is used to form the packaging container 10 in accordance with A first embodiment of the present invention. In FIG. 1, the solid lines represent cuts or edges, and the dashed lines represent crease lines. The solid dark areas represent cut-out sections of material in the blank.

As shown in FIG. 1, the packaging container 10 has a back panel 12 which is connected to a side panel 14 by a scored crease 16. Connected to the side panel 14 by hinged creases 18 and 20 are an upper front extension panel 22 and a lower front extension panel 24. Coupled to the other ends of the upper and lower front extension panels 22 and 24 along creases 26 and 28 is a second side wall panel 30. A tab 32 formed along a crease line 34 at the end of the back panel 12 is glued to the side wall panel.30 to secure the container 10 together for proper assembly. In alternative embodiments, the tab may be attached by staples, rivets or other suitable methods.

Each of the side wall panels 14 and 30 has an elongated central flap 36. Each elongated central flap 36 is designed (using two creases 38 and 40) to fold over 180° relative to the side wall panels 14 and 30, to create a front-facing double-folded surface. When folded, the front-facing double-folded surface is in a slanted orientation inside of the packaging container 10 to assist in holding a vanity top, or the like, and to prevent it from falling through the back panel 12 of the container. The elongated central flap 36 is secured in position by an elongated tab 42 at the end of the elongated central flap 36 that passes through a tab slot 44 in the back panel 12, and then back up inside the container 10 through a second tab slot 46 formed along the crease line 16 between the side panel 14 and the back panel 12 or through a tab slot 46 formed along the crease line 34 between the tab 32 and the back panel 12.

Connected to the lower ends of the side wall panels 14 and 30, the lower front extension panel 24, and the back panel 12 along crease lines 48, 50, 52 and 54 are a series of four flaps 56, 58, 60 and 62 that are used to close off the bottom of the container 10 between the lower front extension panel 24 and the back panel 12. The flap 56 connected to the back panel 12 along the crease line 48 is substantially rectangular in shape and has a plurality of cut-outs 64 and a tab 66. Another bottom flap 60, connected along the crease line 52 to the lower front extension panel 24, is substantially a truncated wedge forming a large tab 68 which has a tab slot 70 that mates and matches with the tab 66 on the bottom flap 56. Connected to each of the side wall panels 14 and 30 are substantially wedge-shaped flaps 58 and 62 that are shaped to engage with the other two bottom flaps 56 and 60 in interlocking relationship to form the bottom closure of the container 10. In preferred embodiments, the bottom of the container 10 cannot be completely closed off by a single bottom flap. All four flaps 56, 58, 60 and 62 must be folded over to entirely close off the bottom of the container 10. However, in alternative embodiments, different bottom flap arrangements may be used.

Connected to the top ends of the two side wall panels 12 and 30, the upper front extension panel 22, and the back panel 12 along crease lines 72, 74, 76 and 78 are a series of flaps 80, 82, 84 and 86 that are used to close off the top of the container 10 between the upper front extension panel 22 and the back panel 12. A first flap 80 connected to the back panel 12 along the crease line 72 is substantially rectangular in shape to close off the top of the container 10. Along the hinge line 72 are a series of tabs 88 and slots 90. Connected to the upper front extension panel 22 along the crease line 76 is another substantially rectangular flap 84 that closes off the top of the container 10 between the upper front extension panel 22 and the back panel 12. The flap 84 has tabs 92 that include a slot 94 for coupling and securing with the tabs 88 and tab slots 90 along the crease line 72 between flap 80 and the back panel 12. Connected to each of the side wall panels 12 and 30 along the crease lines 74 and 78 are substantially rectangular flaps 82 and 86, each of which can be folded inward to provide a support base for holding in place the backsplash area of an enclosed vanity top, or the like. Each of the flaps 82 and 86 has a score line 95 and crease line 96 that forms a wedge-shaped member 98 that is bent relative to the end flaps 82 and 86 to support the back wall of the enclosed vanity top or the like.

The upper front extension panel 22 has a flap 100 connected along the crease 102 that folds inward and connects with the top flaps of the container 10 to provide additional structural rigidity and a double-fold surface on the front of the container 10. The lower front extension panel 24 also has a flap 104 connected along a crease line 106 that is folded over in a double-fold relationship and connected to the bottom flaps to provide structural rigidity for the container 10. The flap 104 has tabs 108 that fit into and are secured by slots 110 formed along the crease line 52 between the lower front extension panel 24 and the bottom flap 60.

The side panels 14 and 30 each include a handle 112 that is coupled to the crease line 38 that can be folded inward to assist in moving the assembled packaging container 10 from place to place.

Figure 2:
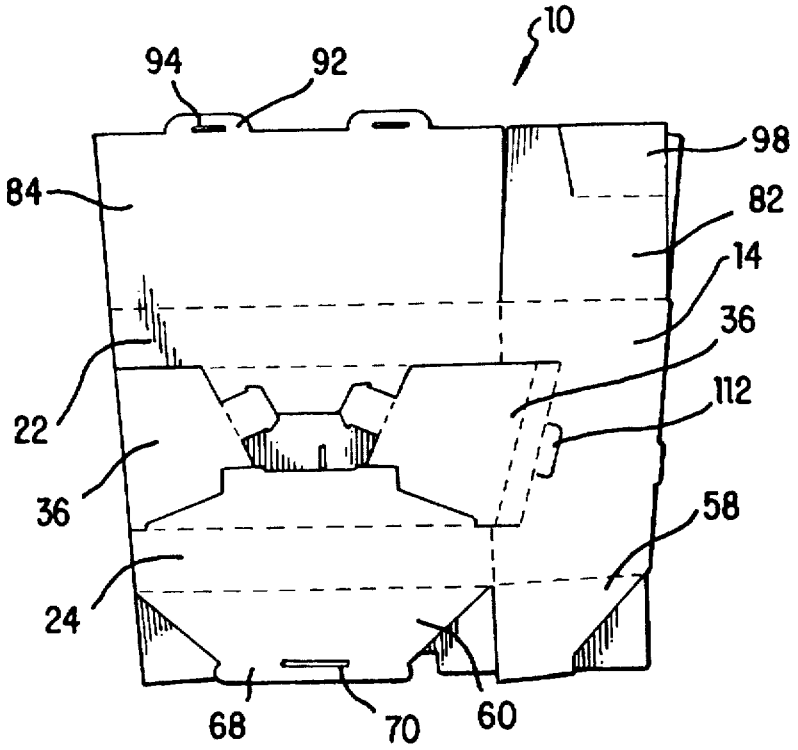
FIG. 2 is a front view of the packaging container in FIG. 1 prior to assembly.
Figure 3:
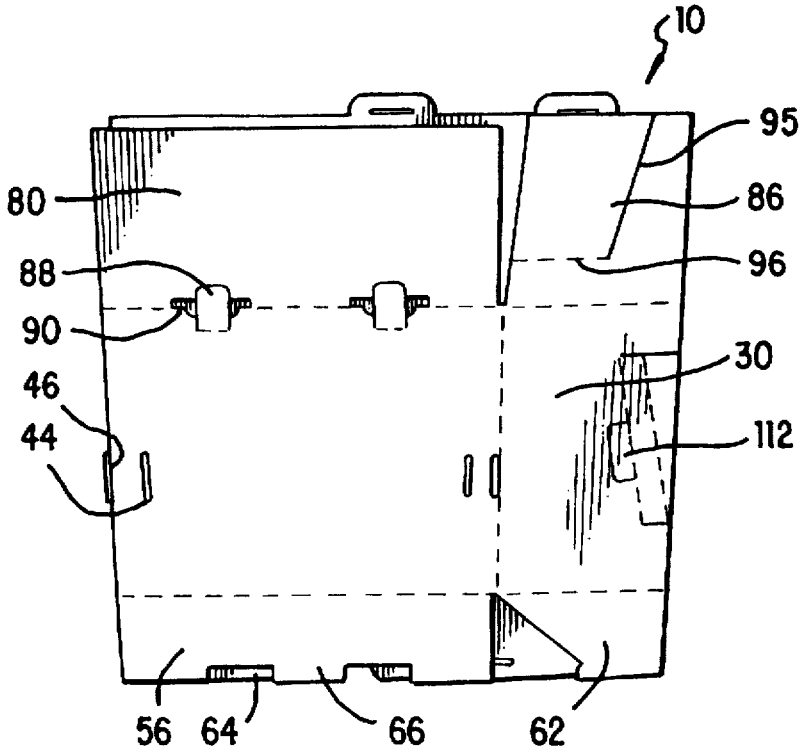
FIG. 3 is a rear view of the packaging container in FIG. 1 prior to assembly.
Figure 4:
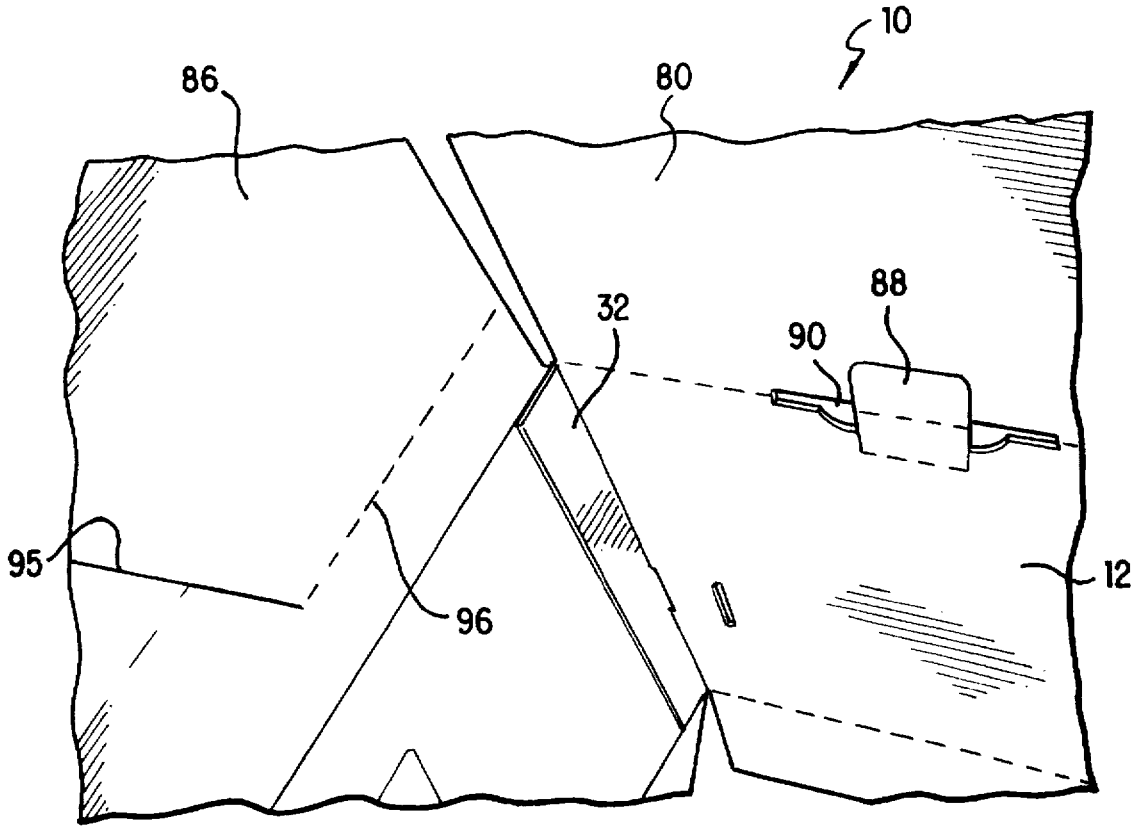
FIG. 4 is a partial interior view of the tab and wall holding together the packaging container of FIG. 1.

In preferred embodiments of the present invention, to form the container 10, a sheet of material is laid flat and then stamped with a die that scores portions of the material and creases other areas of the material. The material is then folded along the crease lines 16, 18, 20, 26, 28 and 34 to form an essentially rectangular-shaped tube. The tube shape is secured by applying adhesive to the tab 32 and/or to the side wall panel 30, and then connecting the tab 34 to the end of the side wall panel 30 (see FIG. 4). Once the adhesive has set, the container 10 is again folded flat so that it may be stored using the least amount of space, and yet be readily assembled without additional gluing (see FIGS. 2 and 3). In alternative embodiments, connectors other than glue, such as rivets, hook-and-loop tape, screws, or the like, may be used.

Figure 8:
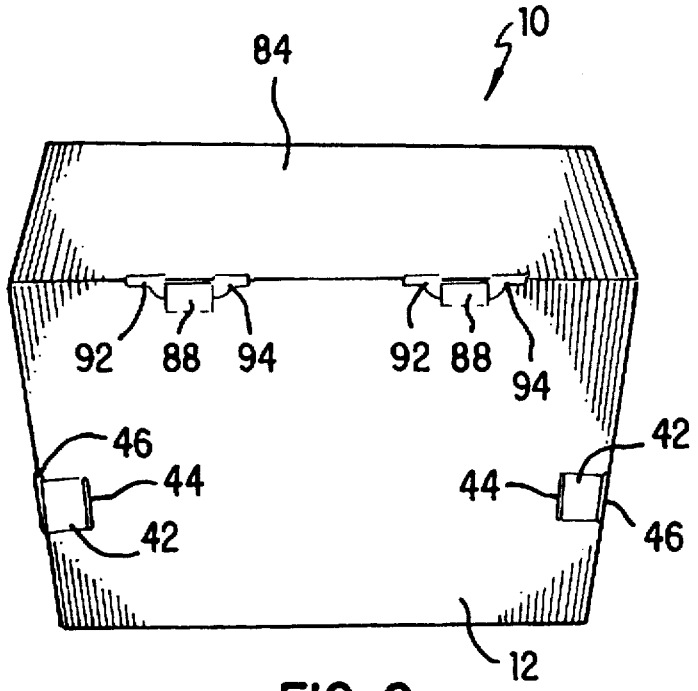
FIG. 8 is a rear perspective view of the packaging container of FIG. 1 after assembly of the top and showing the side wall tabs.

To assemble the container 10, it is placed on a flat or other suitable surface. The container, 10 is then rotated upward and to one side to create a substantially rectangular tube (see FIGS. 4 and 5). Next, the elongated central flaps 36 connected to the side panel members 14 and 30 are folded 90° relative to the side wall panels 14 and 30 along the first crease 38 and then folded over an additional 90° along the second crease 40 of the elongated central flap 36 so that the elongated central flap contacts the back panel 12 of the container 10. At the same time, the tab 42 is passed through the first tab slot 44 in the back panel 12, and then passed back into the container 10 through the second tab slot 46 in the back panel 12 along the crease lines 16 and 34 on the back panel 12 (see FIGS. 8, 9 and 11).

Figure 5:
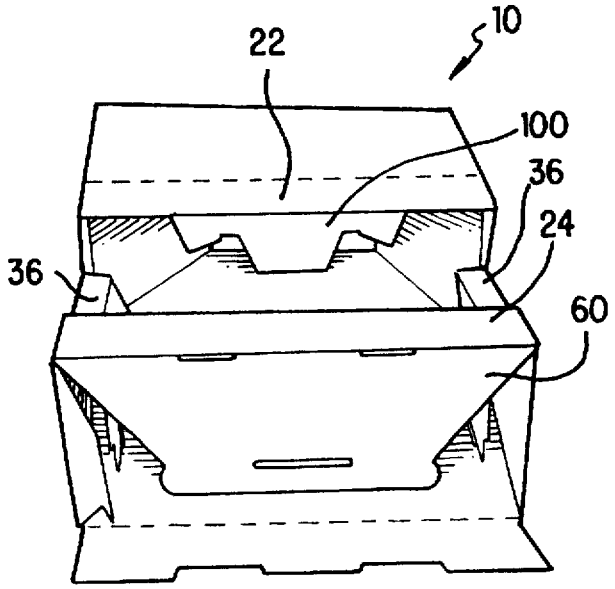
FIG. 5 is a bottom perspective view of the packaging container of FIG. 1 during assembly of the bottom.

Next, all four bottom flaps 56, 58, 60 and 62 are folded at substantially the same time (see FIG. 5). First the bottom flap 56, connected to the back panel 12 along the crease line 48, is folded and rotated up approximately 90° relative to the back panel 12. Next, the bottom flaps 58 and 62 connected to each of the side wall panels 14 and 30, along the crease lines 50 and 54, are folded and rotated up approximately 90° relative to the side panels 14 and 30, to hold the bottom flap 56 in position. The final step, in closing off the bottom of the container 10, is to fold and 5 rotate down, approximately 90° relative to the lower front panel 24, the bottom flap 60 connected to the lower front panel 24 along the crease line 52. While folding over the bottom flap 60, the tab 68 at the end of the truncated wedge-shaped bottom flap 60 is passed behind the tab 66 of the bottom flap 56 to engage the slot 70 in the bottom flap 60. Once the tab 68 is interlocked with the cut-outs 64 on the bottom flap 56 and the tab 66 is engaged with the slot 70 on the bottom flap 60, the bottom flaps 56, 58, 60 and 62 are positioned and secured to close off the bottom of the container 10 to prevent an enclosed vanity top, or the like, from passing through the bottom of the container 10 (see FIGS. 9 and 10). Folding of the four bottom flaps 56, 58, 60 and 62 can be simplified by pushing the flaps slightly beyond 90° into the container 10, so that the flaps 56, 58, 60 and 62 become slightly spaced apart in an orientation that permits the tabs to engage in a locking arrangement.

Figure 9:
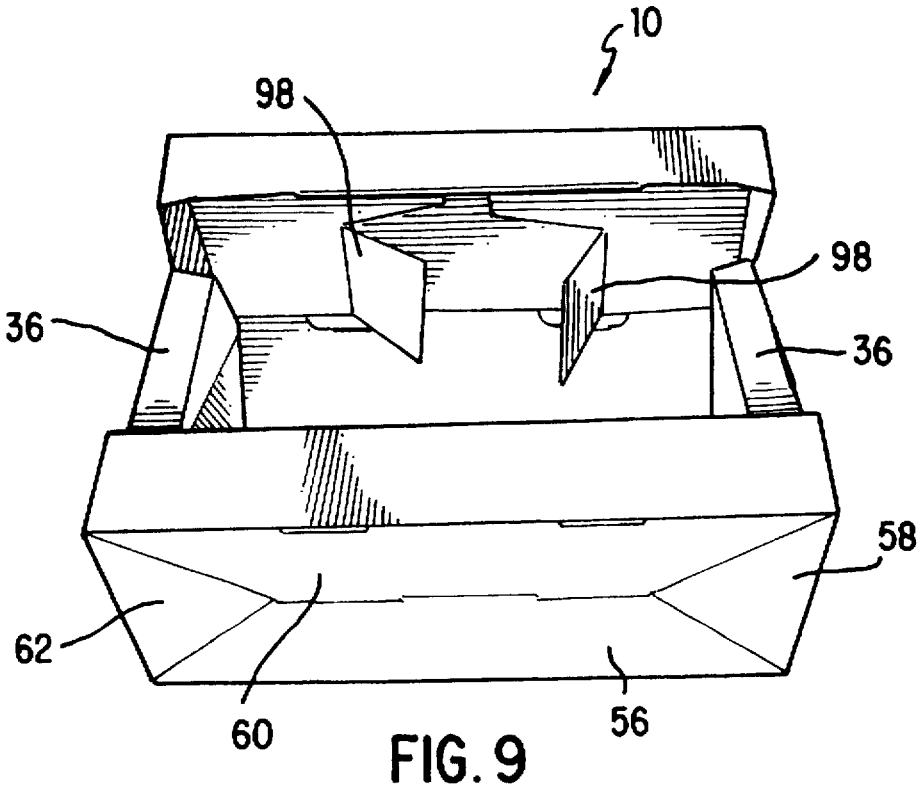
FIGS. 9–13 are various perspective views of the packaging container of FIG. 1 after being assembled. (Photographs corresponding to FIGS. 2–13 are attached as Appendix A and are herein incorporated by reference.)
Figure 10:
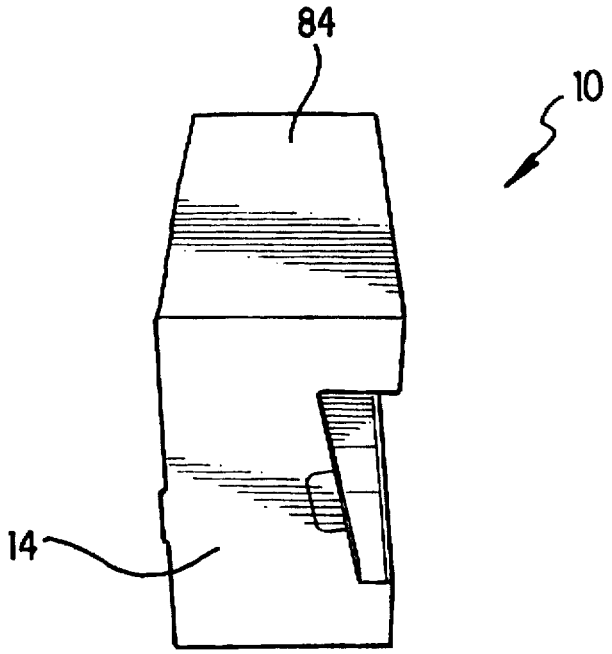

After the bottom flaps 56, 58, 60 and 62 are folded, the flap 104 connected to the lower front panel 24 along the crease line 106 is folded inward 180° and locked into position against the lower front panel 24 by inserting tabs 108 into the slots 110 between the lower front panel 24 and the bottom flap 60 along the crease line 52 (see FIGS. 9 and 10).

Figure 7:
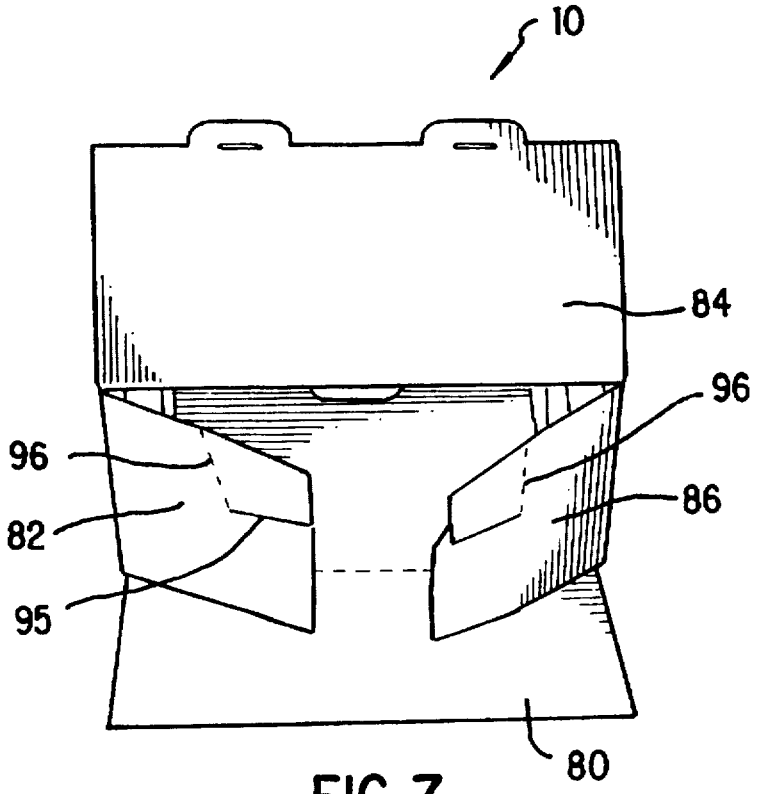
FIG. 7 is a top perspective view of the packaging container of FIG. 1 during assembly of the top.

At this point in the assembly process, a vanity, or the like, may be placed inside the container 10. Next, the end flaps 82 and 86 connected to the side wall panels 14 and 30 along the crease lines 74 and 78 are folded inward 90° relative to the side wall panels 14 and 30 (see FIG. 7). The wedge-shaped section 98 along score line 95 and crease line 96 on each flap 82 and 86 is then folded inward an additional 90°, for a total of 180° relative to the side wall panels 14 and 30, to provide a support surface for holding the backsplash of the vanity top, or the like, in a slanted orientation (see FIG. 9).

Figure 6:
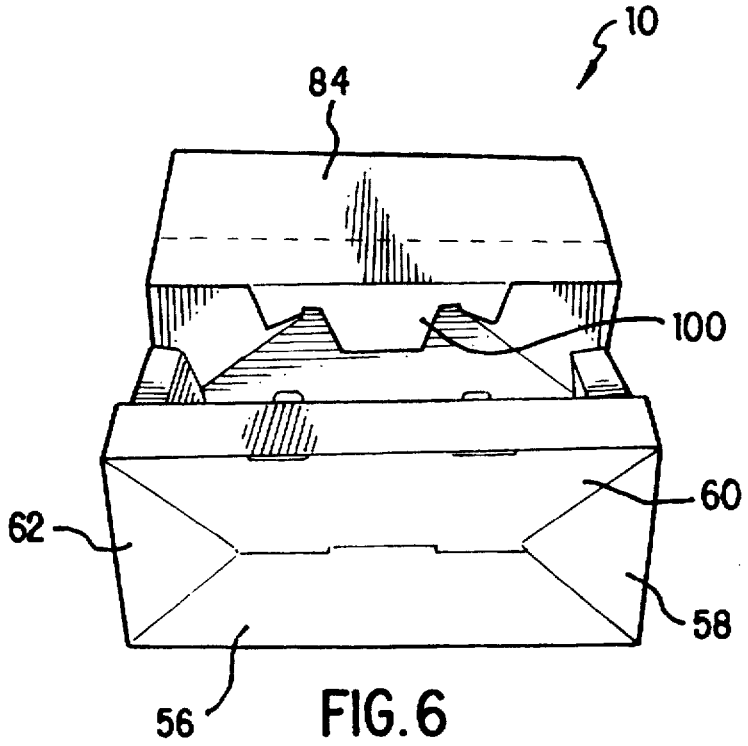
FIG. 6 is a bottom perspective view of the packaging container of FIG. 1 after assembly of the bottom.

Next, the substantially rectangular top panel 80 that is hingedly connected to the back panel 12 along the crease line 72 is folded inward 90° to close off the top of the container 10. Then the remaining top panel 84 that is connected to the upper front panel 22 along the crease line 76 is folded inward 90° to further close off the top of the container 10 (see FIG. 7). Finally, the tabs 92 at the end of the top panel 84 are inserted into the slots 90 formed along the crease line 72 between the back panel 12 and the top panel 80, and the tabs 88 are then inserted into the slots 94 that are formed in the tabs 92 (see FIG. 8). These insert steps secure the top of the container 10 in a closed orientation. The final step is to fold the flap 100 connected to the upper front panel 22 along the crease line 102 inward 180° to add structural rigidity to the upper front panel 22 of the container 10 (see FIGS. 6 and 9).

Figure 11:
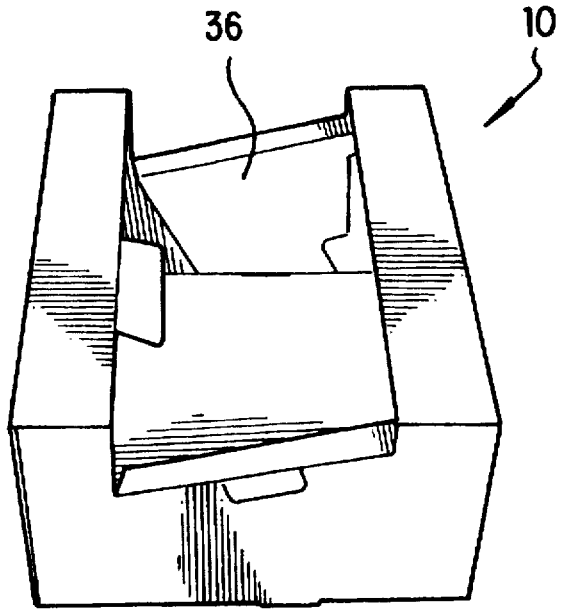
Figure 12:
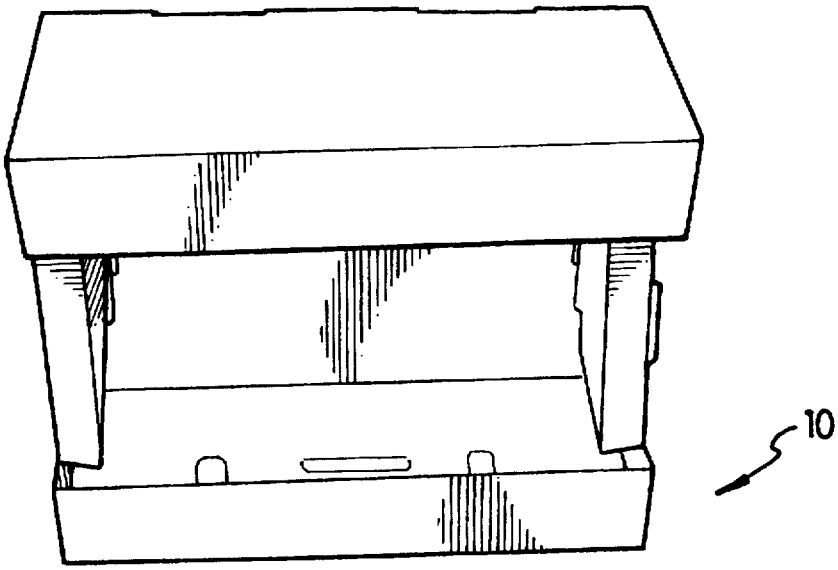
Figure 13:
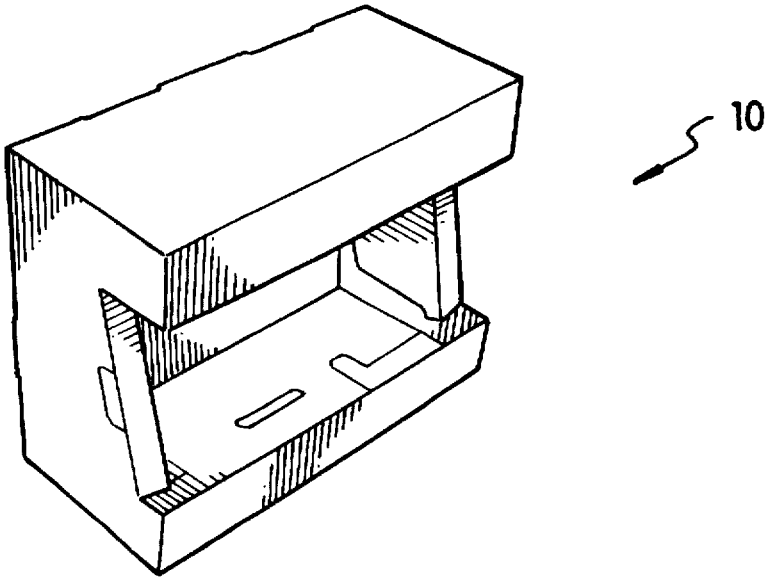

When the vanity top, or the like, is enclosed in the container 10, its under surface is held in place by the double-fold front-facing surface of the elongated central flaps 36 that extend from the side wall panels 14 and 30 (see FIGS. 10 and 11). The backsplash portion of the vanity top, or the like, is prevented from contacting the back panel 12 of the container by the folded wedge shape section 98 of the upper end flaps 82 and 86 connected to the side wall panels 14 and 30 (see FIGS. 9 and 11). The front portion of the vanity top, or the like, is held in position by the comer formed between the lower front panel 24 and the bottom flap 60 (see FIG. 10). The vanity top, or the like, may be viewed from the front without cutting the box open (see FIGS. 12 and 13).

Figure 14:
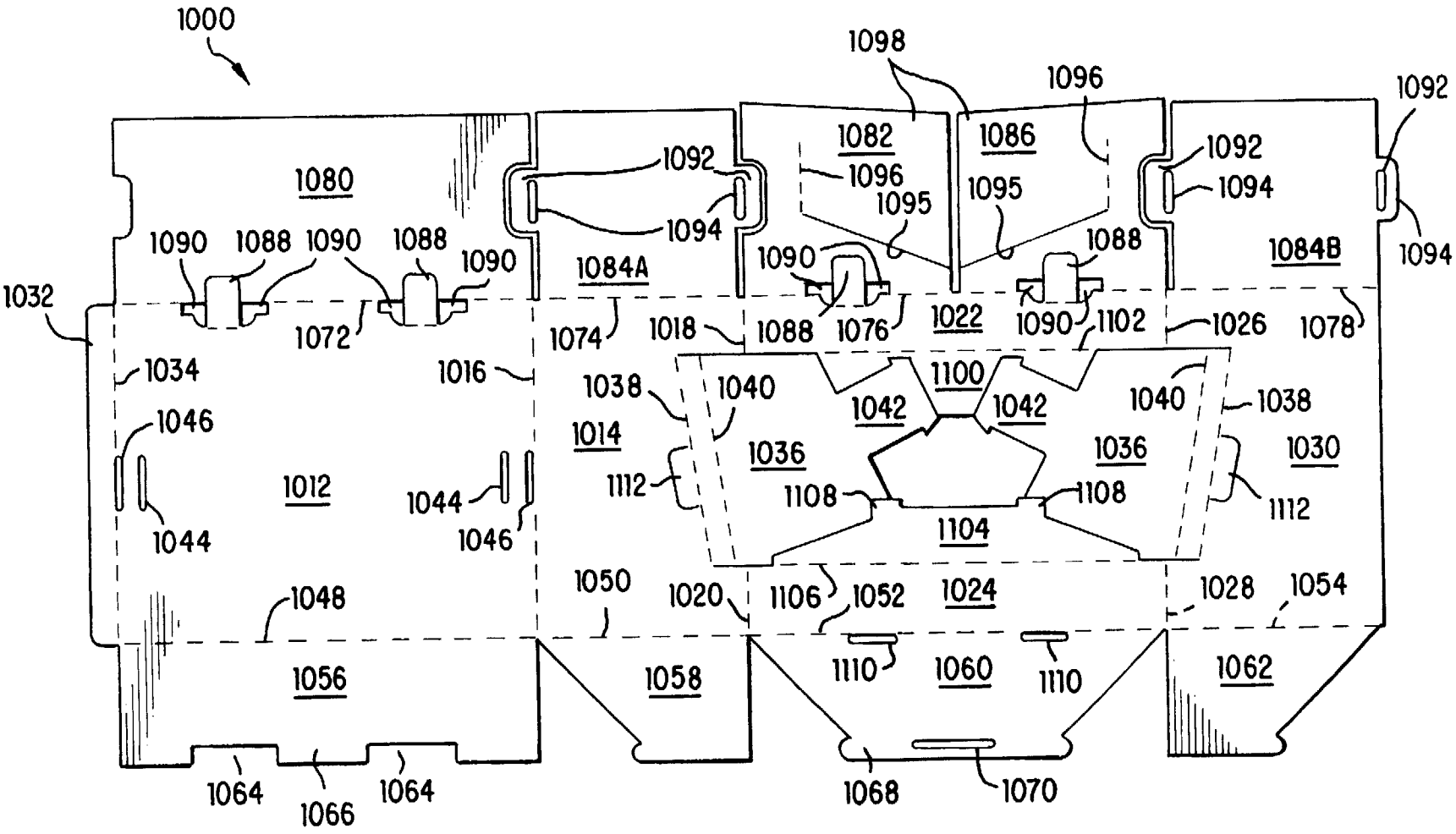
FIG. 14 is a plan view of the packaging container in accordance with a second embodiment of the present invention.

FIG. 14 is a line drawing illustrating a stamped blank that is used to form the packaging container 1000 in accordance with a second embodiment of the present invention. In FIG. 14, the solid lines represent cuts or edges, and the dashed lines represent crease lines. The solid dark areas represent cut-out sections of material in the blank. The packaging container 1000 is similar to the packaging container 10 described above, and similar parts are numbered the same as those above with the addition of one thousand.

The packaging container 1000 differs from the packaging container 10 by the arrangement of upper flaps that are used to close off the top portion of the packaging container 1000. In the illustrated packaging container 1000, the top closing flap that is secured over the top flap 1080 is separated into two separate top panels 1084A and 1084B that close off approximately one-half of the opening rather than a single panel 84, as described above for the packaging container 10. In addition, the separate top panels 1084A and 1084B are connected to the side panels 1014 and 1039, respectively, along crease lines 1074 and 1078, respectively. Each of the top panels 1084A and 1084B includes a pair of tabs 1092 and a slot 1094 for receiving a tab 1088 attached to the ends of the back panel 1012 and the upper front extension panel 1022. Thus, the top flap 1080 that is hingedly connected to the back panel 1012 along the crease line 1072 is folded inward 90° to close off the top of the container 1000. Then the top panels 1084A and 1084B that are connected to the side panels 1014 and 1030, respectively, along the crease lines 1074 and 1078 are folded inward 90° to further close off the top of the container 1000. Next, the tabs 1092 on the sides of the top panels 1084A and 1084B are inserted into the slots 1090 formed along the crease line 1072 between the back panel 1012 and the top panel 1080 and into the slots 1090 formed along the crease line 1074 between the upper front extension panel 1022 and the substantially rectangular flaps 1082 and 1086. Finally, the tabs 1088 are inserted into the slots 1094 that are formed in the tabs 1092. This step secures the top of the container 1000 in a closed orientation. In further alternative embodiments, the flaps 1084A and 1084B may include an additional tab and slot arrangement (not shown but similar to tabs 1088 and 1092 and slots 1090 and 1094) that could be used to secure the end of flap 1084A to the end of flap 1084B.

The packaging container 1000 also includes a pair of substantially rectangular flaps 1082 and 1086. The flaps 1082 and 1086 are connected to the upper front extension panel 1022 along the crease line 1076. Each of the flaps 1082 and 1086 can be folded inward to provide a support base for holding in place the backsplash area of an enclosed vanity top or the like. Also, each of the flaps 1082 and 1086 has a score line 1095 and crease line 1096 that forms a wedge-shaped member 1098 that is bent relative to the end flaps 1082 and 1086 to support the back wall of the enclosed vanity top or the like.

Once a vanity, or the like, is placed inside the container 1000, the end flaps 1082 and 1086 connected to upper front extension panel 1022 along the crease line 1076 are folded inward 90° relative to the upper front extension panel 1022. The wedge-shaped section 1098 along score line 1095 and crease line 1096 on each flap 1082 and 1086 is then folded inward an additional 90°, for a total of 180° relative to the side wall panels 1014 and 1030, to provide a support surface for holding in a slanted orientation the backsplash of the vanity top or the like.

The rest of the flaps and panels of the packaging container 1000 are shaped and folded like the flaps and panels used in the packaging container 10 described above.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A packaging container having a top and a bottom for holding and displaying an item, the packaging container comprising:

a back panel having a first lower flap and a first upper flap;

a pair of side panels, each having a second lower flap, a second upper flap and an elongated central flap;

an upper front extension panel having a third upper flap;

a lower front extension panel having a bottom flap; and a tab connected to the back panel to connect the back panel with one of the pair of side panels, wherein the other of the pair of side panels is connected to the back panel opposite the tab, wherein the upper front extension panel and the lower front extension panel are connected between the pair of side panels to form a substantially rectangular tube, wherein the first lower flap, the pair of second lower flaps and the bottom flap are folded to close off the bottom of the packaging container, wherein the first upper flap, the pair of second upper flaps, and the third upper flap are folded to close off the top of the packaging container, wherein the pair of elongated central flaps are folded relative to the pair of side panels and are coupled to the back panel to provide a slanted support surface for the item, and wherein an opening formed between the pair of side panels, the upper front extension panel and the lower front extension panel between the pair of side panels permits the item to be displayed within the packaging container.

2. A packaging container according to claim 1, wherein the packaging container is formed from corrugated cardboard.

3. A packaging container according to claim 1, wherein the tab connected to the back panel is coupled to one of the pair of side panels by adhesive.

4. A packaging container according to claim 1, wherein each of the pair of side panels includes a handle that is folded to assist in moving the packaging container from place to place.

5. A packaging container according to claim 1, wherein each of the elongated central flaps includes a connecting tab, wherein the back panel includes a plurality of slots for receiving the connecting tab of each of the elongated central flaps, and wherein the elongated central flaps are secured to the back panel by its connecting tab being passed through the plurality of slots.

6. A packaging container according to claim 1, wherein the first lower flap, the pair of second lower flaps and the bottom flap each has a tab structure formed on an end of the flap that is adapted to interlock with the other of the flaps to close off the bottom of the packaging container.

7. A packaging container according to claim 1, wherein the first upper flap and the third upper flap each have a portion of a tab structure formed on each of the upper flaps that is adapted to interlock with the portions of the tab structure of the other upper flaps to close off the top of the packaging container.

8. A packaging container according to claim 1, wherein the item is a bathroom vanity.

9. A packaging container having a top and a bottom for holding and displaying an item, the packaging container comprising:

a back panel having a first lower flap and a first upper flap;

a first side panel having a second lower flap, a second upper flap and a first elongated central flap;

a second side panel having a third lower flap, a third upper flap and a second elongated central flap;

an upper front extension panel having fourth and fifth upper flaps;

a lower front extension panel having a bottom flap; and a tab connected to the back panel to connect the back panel with the second side panel, wherein the first side panel is connected to the back panel opposite the tab, wherein the upper front extension panel and the lower front extension panel are connected between the first and second side panels to form a substantially rectangular tube, wherein the first lower flap, the second lower flap, the third lower flap and the bottom flap are folded to close off the bottom of the packaging container, wherein the first upper flap, the second upper flap and the third upper flap, the fourth upper flap and the fifth upper flap are folded to close off a top of the packaging container, wherein the first and second elongated central flaps are folded relative to the first and second side panels and are coupled to the back panel to provide a slanted support surface for the item, and wherein an opening formed between the first and second side panels, the upper front extension panel and the lower front extension panel between the first and second side panels permits the item to be displayed within the packaging container.

10. A packaging container according to claim 9, wherein the packaging container is formed from corrugated cardboard.

11. A packaging container according to claim 9, wherein the tab connected to the back panel is coupled to one of the pair of side panels by adhesive.

12. A packaging container according to claim 9, wherein each of the first and second side panels includes a handle that is folded to assist in moving the packaging container from place to place.

13. A packaging container according to claim 9, wherein each of the first and second elongated central flaps includes a connecting tab, wherein the back panel includes a plurality of slots for receiving the connecting tab of each of the elongated central flaps, and wherein the first and second elongated central flaps are secured to the back panel by the connecting tabs being passed through the plurality of slots.

14. A packaging container according to claim 9, wherein the first lower flap, the second lower flap, the third lower flap and the bottom flap each has a tab structure formed on an end of the flaps that is adapted to interlock with the others of the flaps to close off the bottom of the packaging container.

15. A packaging container according to claim 9, wherein the first upper flap, second upper flap and the third upper flap each have a portion of a tab structure formed on each of the upper flaps that is adapted to interlock with the portions of the tab structure of the others of the upper flaps to close off the top of the packaging container.

16. A packaging container according to claim 9, wherein the item is a bathroom vanity.

* * * * *